United States Patent [19]

Grohoski et al.

[11] 4,217,681

[45] Aug. 19, 1980

[54] RELEASABLE AND ADJUSTABLE END ATTACHMENT FOR WATCHBAND AND THE LIKE

[75] Inventors: Raymond Grohoski, Watertown, Conn.; George Mileos, Riverdale, N.Y.

[73] Assignee: Timex Corporation, Waterbury, Conn.

[21] Appl. No.: 973,220

[22] Filed: Dec. 26, 1978

[51] Int. Cl.[2] ..... A44C 5/18

[52] U.S. Cl. ..... 24/265 WS; 224/164; 24/265 B

[58] Field of Search ..... 24/265 B, 265 WS; 224/164–170

[56] References Cited

U.S. PATENT DOCUMENTS 2,807,855 10/1957 Rodriguez ..... 24/265 B

FOREIGN PATENT DOCUMENTS 565900 8/1957 Italy ..... 24/230 AS

*Primary Examiner*—Kenneth Downey

*Attorney, Agent, or Firm*—Edward J. Timmer

[57] ABSTRACT

Disclosed is a watch band end attachment adapted to be releasably and adjustably mounted between the spaced lugs of a watch. The end attachment of the invention typically includes a housing, one end of which fits between the spaced lugs and the other end of which is connected to the watch band, and levers on opposite sides of the housing with a sliding member therebetween. The levers have lug-engaging ends disposed in the first end portion of the housing and pivot ends in the second end portion. Cam surfaces of the levers coact with cam-engaging surfaces of the sliding member as the latter is translated from the pivotal ends toward the lug-engaging ends of the levers to cause the lug-engaging ends to pivot and extend through the side apertures in the housing and engage the lugs of the watch. Reverse movement of the sliding member disengages the end attachment from the watch. Accidental disengagement is prevented by locking means typically in the form of a spring associated with the levers or sliding member. Attachment and detachment is accomplished by simple manipulation of a finger tab connected to the sliding member and accessible from outside the housing.

25 Claims, 11 Drawing Figures

RELEASABLE AND ADJUSTABLE END ATTACHMENT FOR WATCHBAND AND THE LIKE

FIELD OF THE INVENTION

The present invention relates to means for attaching a watch strap, band or the like to the spaced lugs of a watch case and, more particularly, to an end attachment which is not only adjustable to snuggly fit between lugs of various spacing but also is readily releasable from and attachable to the lugs by simple finger manipulation of the watch wearer.

DESCRIPTION OF THE PRIOR ART

At the present time, wrist watch bands, straps, bracelets and the like are secured to the spaced projecting lugs on a wrist watch case by means of a spring bar connector. The connector customarily employed comprises a cylindrical tube within which is mounted a pair of pins that are spring urged outwardly. This type of connector or end attachment has found almost universal acceptance in the field. In general, the end attachment is inserted in a loop or other passage at the ends of the watch band or strap. To attach the band or strap to the watch lugs, one projecting pin is inserted in the hole or opening in the lug and then the other pin is first retracted into its tubular housing, aligned with the hole in the other lug and finally released to urge the pin in the hole. Retraction of the one projecting pin is usually accomplished by pushing the end of the pin inwardly until it is retracted sufficiently to align the spring bar in proper position to the lug holes. The overall operation of inserting the spring bar in position between the lugs of the watch case is a tedious one and is often quite difficult because of the shape and contour of the watch. Further, the projecting pins are conventionally quite small and difficult to retract without the aid of a tool. Of course, removal of the end attachment is likewise fraught with difficulties.

There thus has been a recognized and long felt need to provide an end attachment for a watch band which the ordinary watch band user can operate himself to easily attach and detach the watch band relative to the watch case lugs for purposes of replacement of a worn band with a new one or of appearance by substitution of a different band style or design for another. The following patents illustrate prior art endeavors to satisfy that need:

| COUNTRY | PAT. NO. | DATE | INVENTOR |
|---|---|---|---|
| U.S. | 1,999,707 | April 30, 1935 | Spiegel |
| U.S. | 2,009,483 | July 30, 1935 | Dinhoffer |
| U.S. | 2,399,667 | May 7, 1946 | Fikuart |
| U.S. | 2,791,018 | May 7, 1957 | Garon |
| U.S. | 2,870,511 | January 27, 1959 | Sand |
| U.S. | 2,876,521 | March 10, 1959 | Legman |
| U.S. | 2,901,806 | September 1, 1959 | Henshel |
| U.S. | 3,565,304 | February 23, 1971 | Kalinsky |
| U.S. | 3,605,212 | September 20, 1971 | Bruner |
| U.S. | 3,865,107 | August 22, 1972 | Epiard |
| U.S. | 3,707,744 | January 2, 1973 | Manzo et al |
| U.S. | 3,818,552 | June 25, 1974 | Droz |
| U.S. | 3,939,534 | February 24, 1976 | Hayes |
| U.S. | 3,964,250 | June 22, 1976 | Manchester |
| U.S. | 4,068,355 | January 17, 1978 | Rey |
| British | 397,473 | February 22, 1932 | Chumas |
| British | 620,704 | August 2, 1946 | Napper |
| British | 797,053 | September 21, 1956 | Napper |

-continued

| COUNTRY | PAT. NO. | DATE | INVENTOR |
|---|---|---|---|
| British | 869,976 | October 28, 1959 | Napper |
| French | 331,316 | July 8, 1957 | Tabert |

Another problem associated with the conventional spring bar attachment scheme is that the watch case lugs between which the watch band end attachment is to be secured are not uniformly spaced from one particular watch to another. Since any spacing or gap between the band or strap end and the watch lugs is unsightly and the relative sliding of the watch case and the band end gives rise to a "sloppy" feeling to the wearer, prior art workers have undertaken the task of developing end attachments which are adjustable in that the attachment expands or contracts to automatically fit various watch lug spacings. Representative of this effort are, among others, the Rodriguez patent, U.S. Pat. No. 2,807,855 issued Oct. 1, 1957; the Reith patent, U.S. Pat. No. 3,657,284 issued July 11, 1972; the Berth patent, U.S. Pat. No. 3,897,612 issued Aug. 5, 1975 (now U.S. Pat. No. Re. 28,793 issued May 4, 1976) and the Vargas patent U.S. Pat. No. 4,023,243 issued May 17, 1977. Generally, these adjustable end attachments include an outer tubular member with inner sliding tubular inserts at opposite ends, the sliding inserts being urged outwardly toward the watch lugs for adjustment purposes by various spring means.

The Reith patent, U.S. Pat. No. 3,889,323 issued June 17, 1975, represents a recent attempt to provide a watch band end attachment which is releasably attached to the watch case lugs and also is adjustable to different lug spacings. The end attachment, however, is disadvantageous since it requires two adaptors, one attached to each spring bar of the watch case, and clasp means connected to the ends of the watch band for engaging the adaptors. The Reith patent includes an extensive listing of relevant prior art not already cited herein.

SUMMARY OF THE INVENTION

Accordingly, the present invention provides a novel end attachment for a watch band, strap and the like which overcomes the disadvantages of the prior art attachments. The end attachment of the invention not only is releasably attachable to the spaced lugs of the watch by simple finger manipulation but also is adjustable within limits to accomodate different lug spacings, all without the need for conventional spring bars or special adaptors. The end attachment is advantageous in that it is useful with watches having spaced lugs for band or strap attachment and the majority of watches made and sold today are of that construction.

In a typical embodiment of the present invention, the end attachment includes a housing having a first end portion adapted to fit between a pair of spaced watch lugs and a second end portion adapted for connection to the end of the watch band or strap, the housing having side apertures one of which faces one lug and the other of which faces the other lug of the pair. Pivotably mounted in the housing is a pair of spaced levers each having a lug-engaging portion positioned in the first end portion of the housing between the lugs. A sliding member is disposed in the housing between the spaced levers with a portion thereof accessible from outside the housing for manual translation of the sliding member between the levers to cause via a camming or wedging action the lug-engaging portions to pivot through the side apertures toward the respective facing lug for engagement therewith or away from the facing lug for disengagement therefrom. Movement of the lug-engaging portions of the levers toward and into engagement with the lugs not only adjusts the end attachment between the spaced lugs but also fastens the end attachment securely thereto. In order to prevent accidental disengagement of the end attachment from the lugs, means, preferably in the form of a spring accociated with the levers or sliding member is provided for releasably locking the levers and sliding member together in the position which effects engagement of the end attachment.

In a preferred embodiment of the present invention, one of the levers is adjacent one side aperture and the other is similarly disposed next to the other side aperture, each lever including a lug-engaging end in the first end portion of the housing and a pivotal end in the second end portion with a shank portion therebetween. A cam surface is further associated with each lever. Disposed in the housing between the levers is a sliding member having cam-engaging surfaces to coact with the cam surfaces of the levers. A finger tab projects from the sliding member through an opening in the housing so that the sliding member can be translated from one end of the levers to the other by manipulation of the wearer. The cam surfaces of the levers and cam-engaging surfaces of the sliding member are configured and positioned in relation to one another such that movement of the sliding member from the pivotal ends toward the lug-engaging ends of the levers causes the levers to pivot about the pivotal ends toward the respective side apertures with the lug-engaging ends extending through the side apertures for engagement with the respective lugs, thereby fastening the end attachment and watch band or strap attached thereto to the watch case. Reverse movement of the sliding member from the lug-engaging ends toward the pivotal ends of the levers causes disengagement from the watch lugs. The releasable locking means includes a spring associated with either the levers or sliding member or both.

The end attachment of the invention finds use with all types of watch bands or straps, whether made of leather, fabric, plastic, metal or combinations thereof and whether they are expansible or nonexpansible.

DESCRIPTION OF THE PREFERRED EMBODIMENT

Figure 1:
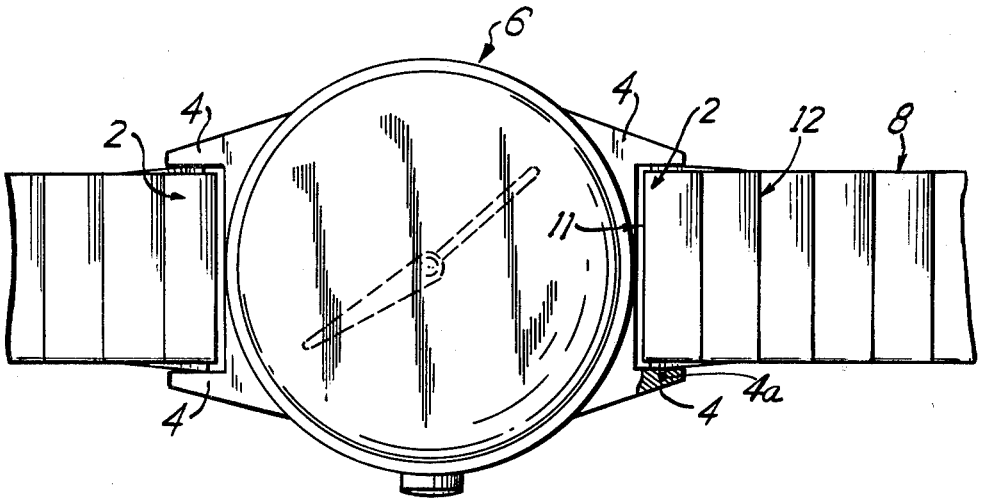
FIG. 1 is a top plan view showing a watch and watch band connected together by means of the end attachment embodying the invention, a portion of one lug being broken away and shown in section.

As shown in FIG. 1, the end attachments 2 of the invention are adapted to be connected between the pairs of laterally spaced lugs 4 of any conventional wrist watch 6. Although an expansible link-type watch band 8 of well known construction is illustrated in the figure, this is merely for purposes of illustration, rather than limitation. The end attachment of the invention is useful in securing any watch band construction which may be expansible or nonexpansible and made of leather, plastic, fabric, metal or or composites thereof to the watch. As used herein, watch band is intended to include bands, straps, bracelets and the like.

FIGS. 2 through 5 illustrate in greater detail the end attachments of FIG. 1, both attachments being of the same construction. The end attachment 2 is shown as comprising a housing 10, typically of formed sheet metal such as stainless steel, having a first end portion 11 adapted to fit between the spaced lugs of the watch (see FIG. 1) and a second end portion 12 adapted for connection to the watch band. As illustrated for the link-type band of FIG. 1, the housing 10 includes an end channel **10*a* of bent sheet metal to be coupled with the adjacent channel of the watch band in typical prior art fashion by leaf springs (not shown). Of course, other connector means would be associated with the second end portion 12 of the housing for other types and constructions of bands. Suitable connector means for the various types of available bands are well known to those skilled in the art. For purposes to be described immediately below, the housing also includes side apertures 14 one of which faces one lug and the other of which faces the other lug when the end attachment is placed in working relation therebetween, see FIG. 1**.

Figure 2:
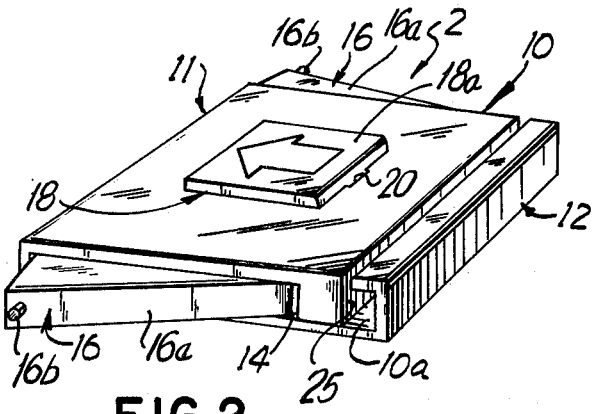
FIG. 2 is a perspective view of a first end attachment embodiment showing the sliding member tab on the bottom or wrist side thereof.
Figure 4:
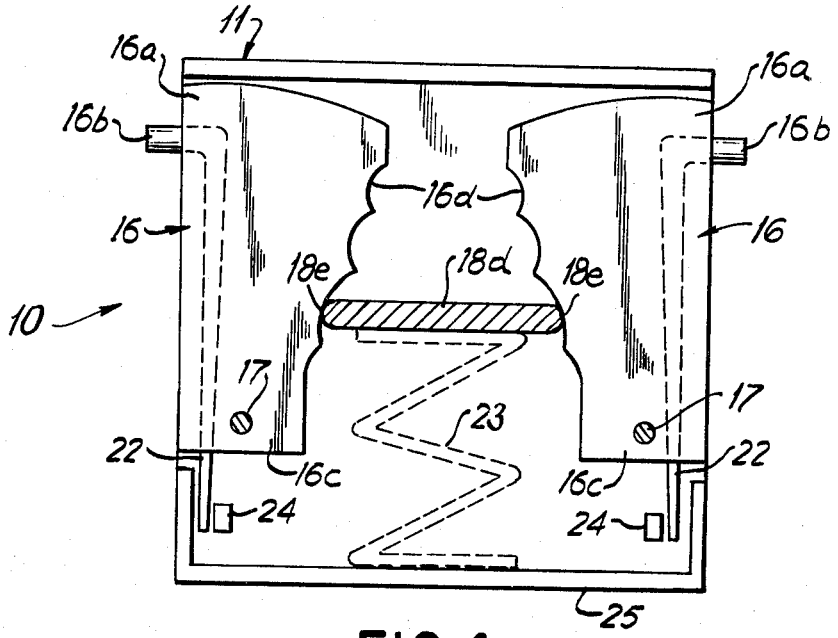
FIG. 4 is a bottom view of the end attachment with the bottom (wristside) wall of the housing and portions of the sliding member removed for clarity showing the relationship between the levers and sliding member.
Figure 5:
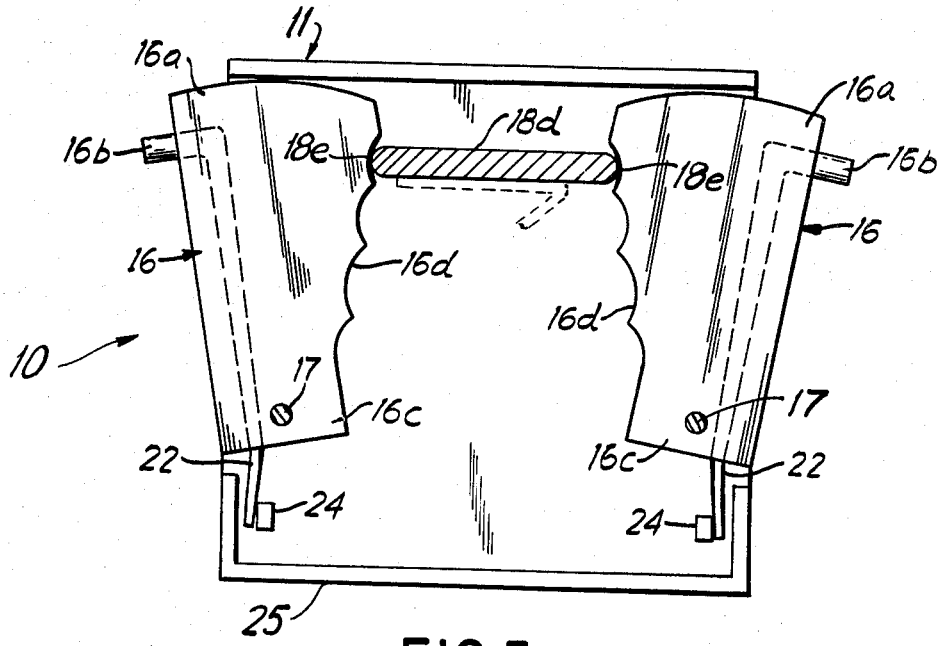
FIG. 5 is similar to FIG. 4 and shows the levers fully extended through the side apertures.

As shown most clearly in FIGS. 2, 4, and 5, a pair of levers 16 is disposed in the housing 10 with the levers on opposite sides thereof, one adjacent one side aperture 14 and the other adjacent the other side aperture. The levers each include a lug-engaging end **16*a* disposed in the first end portion 11 of the housing for effecting engagement with the respective lugs of the watch. In the majority of watches made and sold in recent years, the lugs of the watch includes opposed holes for receiving the ends of the conventional spring bar, thereby locking the band to the case. One such engagement hole 4*a* is shown in FIG. 1 for illustration. The lug-engaging end 16*a* of the levers is especially adapted to couple or engage with these holes by having pins 16*b* projecting therefrom toward the respective lugs. These pins may be integral with the lever, for example, stamped or formed with the lever of sheet metal, or they may be a separate piece suitably attached to the lever by conventional metal joining techniques. By configuring the lug-engaging ends 16***a* of the levers to include these projecting pins, the end attachment of the invention becomes useful with the majority of watches in use today. The levers 16 also each include a pivot end 16*c* disposed in the second end portion 12 of the housing. The pivotal end may rotate about a locating pin 17 connected to the housing or merely within the confines of the housing walls as will be more fully explained herebelow. Each lever includes a stepped cam surface 16*d* along facing longitudinal sides for purposes also to be described hereinbelow.

Figure 3:
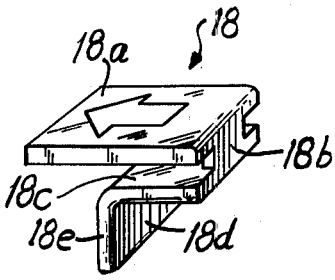
FIG. 3 is a perspective view of the sliding member of the end attachment.

Positioned within the housing between the levers 16 is a sliding member 18. The sliding member is adapted by having a projecting tab 18*a* passing through a suitably disposed longitudinal slot 20, preferably in the bottom wall of the housing, to be manually translated from one end of the levers to the other. It is preferred that the tab project through the bottom wall which would be against the wrist of the wearer and thus out-of-sight when the watch is worn. The tab 18*a* is constructed to overlap the bottom wall of the housing to cover as much as possible of the slot 20. As shown in FIG. 3, the tab 18*a* of the sliding member is connected to an L-shaped appendage by a notched vertical wall 18*b* which is received in the slot 20. The L-shaped appendage includes a horizontal wall 18*c* which supports a vertical wall 18*d*. It is the side edges 18*e* of the vertical wall which function as cam-engaging surfaces to coact with the cam surfaces 16*d* of the levers, for example, as best seen in FIGS. 4 and 5. The cam surfaces 16*d* include four steps with which the side edges of the sliding member coact as the sliding member is translated from the pivotal end toward the lug-engaging end of the levers. In FIG. 4, the sliding member is engaged with the second step of the cam surfaces whereas in FIG. 5 the fourth step is engaged. It is apparent that as the sliding member is moved from the first step through the fourth step, the levers are caused to rotate or pivot via the camming or wedging action by the sliding member toward the respective side aperture with the lug-engaging ends 16*a* extending in increasing manner outwardly toward the opposite watch lugs. In this way, the end attachment can accomodate different lug spacings within limits and also can be easily attached to the lugs by simple finger manipulation of tab 18*a*. Of course, the adjustment capability of the end attachment can be varied as desired by suitable choice of the inward angle of the cam surfaces 16*d* and the number and size of steps in the surfaces. For a given application, these parameters can be readily determined by those skilled in the art using established engineering design techniques.

To maintain the cam surfaces 16*d* in secure engagement with cam engaging surfaces 18*e*, for example to prevent accidental disengagement, locking means in the form of spring 22 associated with each lever 16 is provided. As shown in dotted lines, spring 22 may be a one piece part including projecting pins 16*b* embedded or attached to the levers. A restraining post 24 is provided near the end of each spring 22 to effectuate spring action against the levers to lock the cam surfaces 16*d* against the cam-engaging surfaces 18*e*. Alternatively, a central Z-shaped spring 23 (dotted lines) may be positioned between the depending wall 18*d* of the sliding member and the end wall 25 of the housing to exert the required force on the sliding member to lock the cam-engaging surfaces against the cam surfaces of the levers. Of course, those skilled in the art will recognize that other locking means may be used in the invention.

Figure 6:
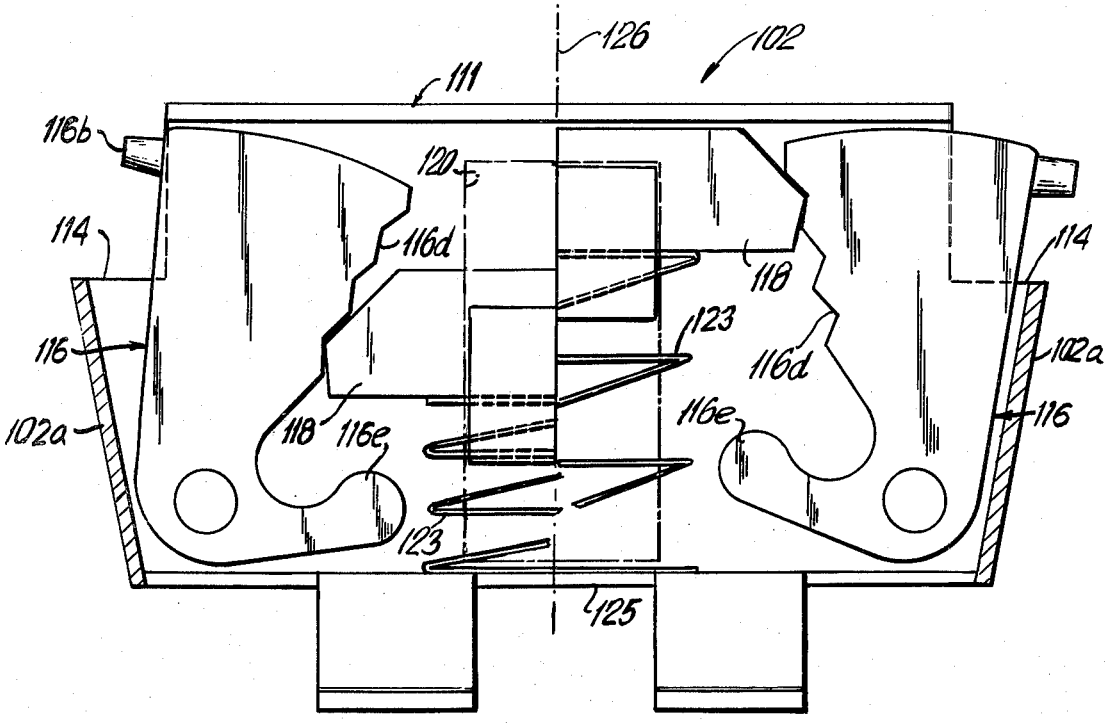
FIG. 6 is a top view of a second end attachment embodiment with the upper wall of the housing removed, the figure being split along the centerline to show the lever and sliding member retracted on the left side and in the expanded position on the right side.

FIG. 6 represents a second embodiment of the present invention in which the housing 102 of the attachment is somewhat differently configured to provide side apertures 114 near the first end portion 111 only. This feature should help minimize entry of dirt and other foreign matter into the housing. The sidewalls 102*a* of the housing can be angled outwardly as shown or otherwise configured to blend with the lines of the watch case and watch band attached thereto. FIG. 6 is split along its centerline 126 to show the slide and lever in the retracted position on the left side and in the expanded position on the right side. It is apparent that the internal working of this end attachment is similar to that of the first embodiment. One notable difference however is that the levers 116 include inwardly projecting extensions 116*e* near the pivotal ends. These extensions cooperate with the sliding member to quickly disconnect the end attachment from the watch lugs when the wearer fully depresses the sliding member 118 against the end wall 125 of the housing against the tension of spring 123. Spaced tubular members extend from end wall 125 for connecting the attachment to a watch band of the link type.

Figure 7:
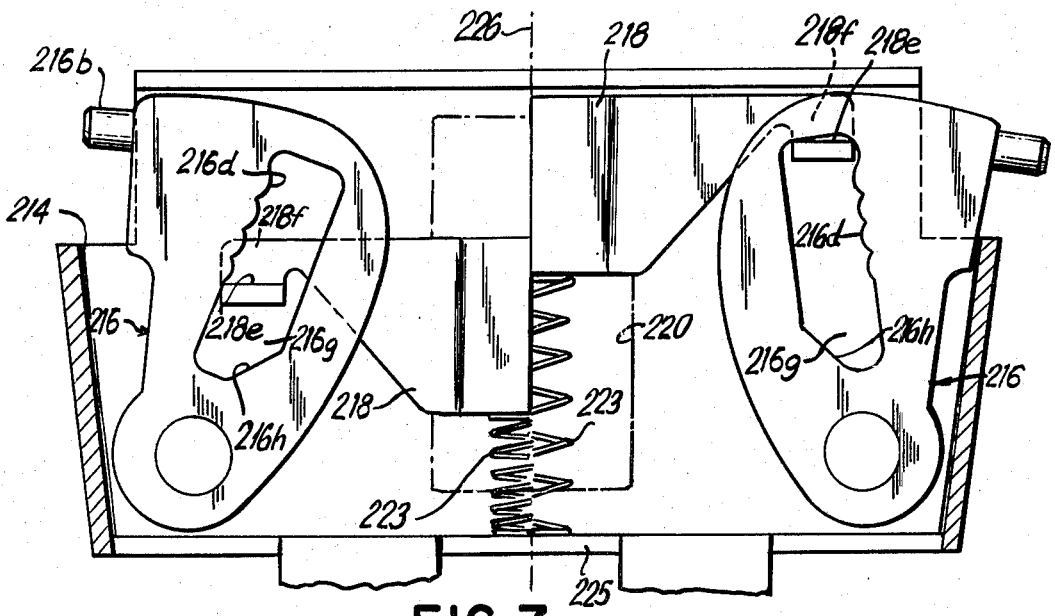
FIG. 7 is a top view of a third end attachment of the invention with the upper wall of the housing removed, the figure being split along the centerline as in FIG. 6.

FIG. 7 illustrates a third embodiment of the invention in which the levers 216 include slots 216*g* which define cam surfaces 216*d*. The sliding member 218 includes side arms 218*f* having cam-engaging edges 218*e* for coacting with the cam surfaces. The figure is split along the centerline for purposes explained in relation to FIG. 6. Instead of a Z-shaped spring, a conventional coil spring 223 may be employed in this embodiment. Quick disconnect of the attachment from the watch is effected by coaction between cam edges 218*e* and angled surface 216*h* defined by slots 216*g*.

Figure 8:
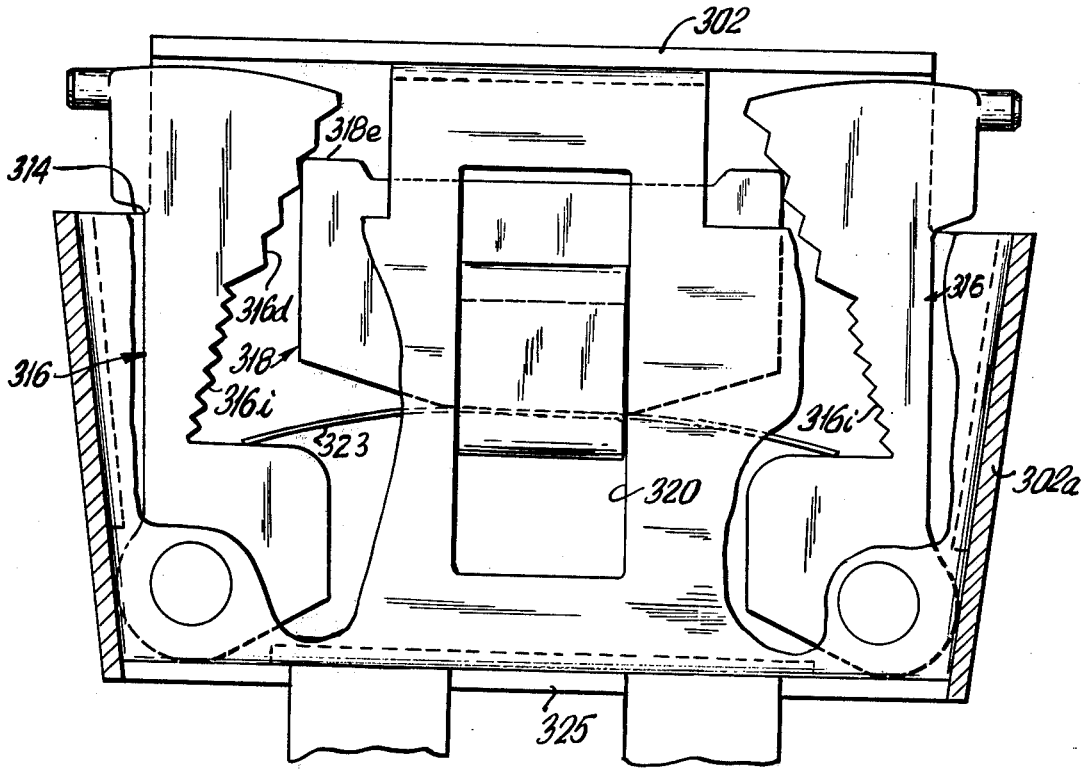
FIG. 8 is a bottom view of a fourth end attachment of the invention with portions of the bottom wall of the housing removed for clarity, the figure showing the sliding member carrying the locking leaf spring.

A fourth embodiment of the present invention is illustrated in FIG. 8. This embodiment differs from the others generally in that a leaf spring 323 is attached to the sliding member 318 and travels with it to lock the levers and sliding member by engagement with locking cam surfaces 316*i* on the shank of each lever. Accidental disengagement is thereby prevented. The leaf spring may be made of spring steel with elastic properties to produce the desired locking action. The leaf spring may be attached to the sliding member by rivets, adhesive and other conventional means and may, if desired, be received in a suitable channel or groove through the sliding member.

Figure 9:
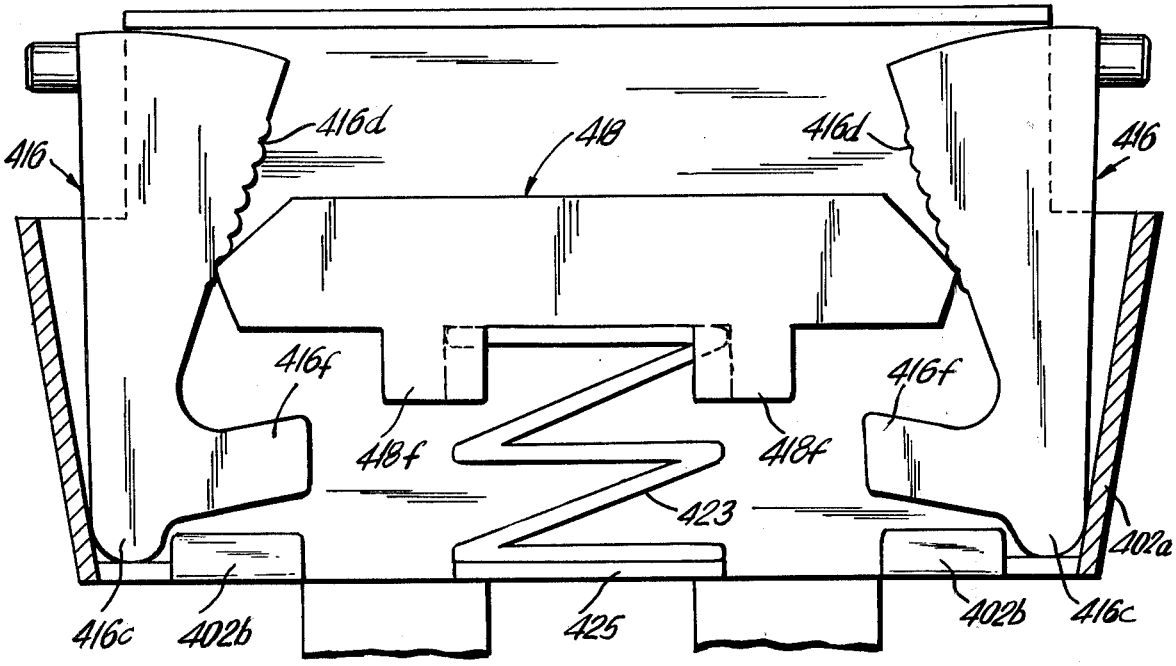
FIG. 9 is a bottom view of a fifth end attachment embodiment with the lower wall of the housing and the finger tab of the sliding member removed.
Figure 10:
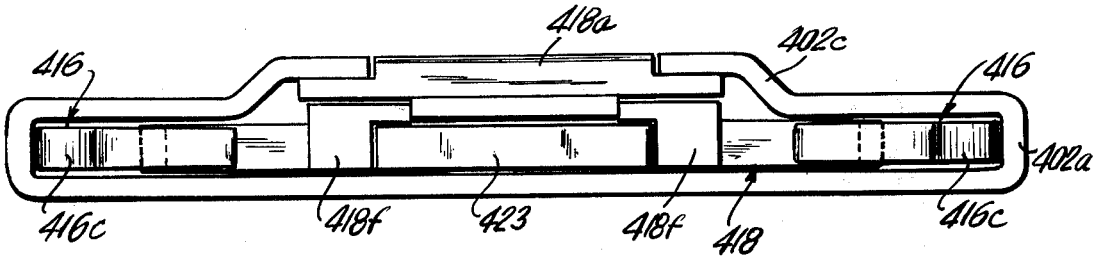
FIG. 10 is an end view of FIG. 9 with the lower wall of the housing and finger tab in place but with the end wall 425 removed.

FIGS. 9 and 10 show a fifth embodiment of the invention in which the levers 416 include pivotal ends 416*c* which rotate within the confines of the housing defined by side wall 402*a* and inwardly bend tab 402*b*. In this way, the need for locating pins like those illustrated in the preceding figures is eliminated and the complexity and cost of the end attachment are thereby reduced. As shown, the fifth end attachment embodiment includes many similar components as those embodiments already discussed. It differs from the others, however, in the configuration of the bottom wall 402*c* of the housing which is contoured to overlap the longitudinal edges of the finger tab 418*a* of the sliding member 418, as shown in FIG. 10. This particular configuration is advantageous from the standpoint of minimizing entry of dirt or other foreign matter into the housing. In this embodiment, tab 418*a* may be an independent component connected by suitable mechanical means to the sliding member 418 or it may be formed integrally therewith. The surface of the tab 418*a* which is contacted by the finger of the wearer is preferably serrated to improve contact. By making the tab a separate component, it may be conveniently colored, patterned or the like to present different asthetic qualities in relation to the housing and watch band. As shown, the locking spring 423 has one end abutting against end wall 425 of the housing and another end which is received between projecting lugs 418*f* of the sliding member.

Figure 11:
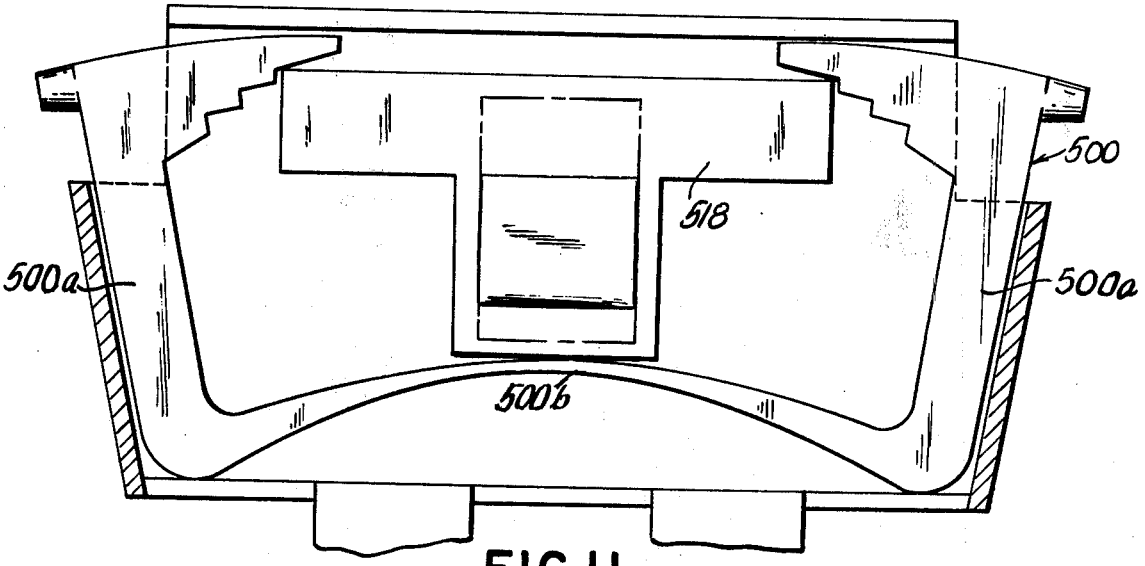
FIG. 11 is a top view of a sixth end attachment of the invention with the upper wall of the housing being removed for clarity, the figure showing the levers and locking spring as a one-piece component.

FIG. 11 illustrates a sixth embodiment of the invention in which the levers and locking spring are made of a one-piece component 500, such as a metal stamping. It is apparent that the internal structure of the end attachment is thus greatly simplified. If desired, the lever portions 500*a* and the spring portion 500*b* can be fabricated individually and then joined together by conventional techniques to provide the component. As is apparent, the sliding member 518 functions in the same manner as already described. An important advantage of this embodiment is that extension of the lug-engaging ends outwardly through the side apertures is achieved with the minimum movement of the sliding member.

While six desirable embodiments of the invention have been shown in the drawings, it is to be understood that this disclosure is for the purpose of illustration only and various changes in shape, proportion and arrangement of parts as well as in the substitution of equivalent elements for those shown and described herein may be made without departing from the spirit and scope of the invention as set forth in the appended claims.

I claim:

1. An end attachment for watch bands to be releasably and adjustably mounted between the spaced lugs of a watch, comprising, (a) a housing having a first end portion adapted to fit between the spaced lugs and a second end portion adapted for connection to the watch band, said housing having side apertures one of which faces one lug and the other of which faces the other lug;

(b) a pair of spaced, non-intersecting levers pivotably mounted in the housing, each lever having a lug-engaging portion disposed in the first end portion of the housing adjacent one of said side apertures;

(c) a sliding member disposed in the housing between the spaced levers with a portion thereof accessible from outside the housing for manual translation of said member between said levers along the length thereof to cause via a camming action against the levers the lug-engaging portions thereof to pivot through the side apertures toward the respective facing lug for engagement therewith, thereby adjusting and fastening the end attachment to the watch, or away from the respective facing lug for disengaging the end attachment from the watch; and (d) means for releasably locking said levers and sliding member together in the position which effects engagement of the end attachment to the watch.

2. The end attachment of claim 1 wherein the lug-engaging portion of each lever includes an outwardly projecting pin to be received in and engage a corresponding hole in each watch lug.

3. The end attachment of claim 1 wherein the spaced levers are disposed on opposite sides of the housing adjacent the respective side apertures.

4. The end attachment of claim 3 wherein one end of each lever corresponds to the lug-engaging portion and is disposed in the first end portion of the housing and the other end of each lever is pivotably mounted in the second end portion of the housing.

5. The end attachment of claim 1 wherein the sliding member includes a projecting tab manually operable from outside the housing.

6. The end attachment of claim 5 wherein the housing includes an elongated access opening in a wall between said side apertures, through which opening the tab of the sliding member projects.

7. The end attachment of claim 1 wherein the locking means comprises a spring associated with each lever.

8. The end attachment of claim 1 wherein the locking means comprises a spring associated with the sliding member.

9. An end attachment for watch bands adapted to be releasably and adjustably mounted between spaced lugs of a watch, comprising:

(a) a housing having a first end portion adapted to fit between the spaced lugs and a second end portion adapted for connection to the watch band, said housing having side apertures one of which faces one lug and the other of which faces the other lug;

(b) a pair of levers disposed in the housing, one lever adjacent one side aperture and the other adjacent the other side aperture, each lever having a lug-engaging end disposed in the first end portion of the housing and a pivotal end disposed in the second end portion with a shank portion therebetween, each lever having a cam surface;

(c) a sliding member disposed in the housing between said levers with a portion thereof accessible from outside said housing for manual translation of said member between the levers from one end thereof to the other, said sliding member including cam-engaging surfaces configured and positioned in relation to the cam surfaces of said levers such that the movement of the sliding member from the pivotal end toward the lug-engaging end of said levers causes said levers to pivot about the pivotal ends toward the respective side apertures with lug-engaging ends extending through the side apertures for engagement with the respective lugs, thereby adjusting and fastening the end attachment to the watch, and such that reverse movement of the sliding member causes disengagement of said lug-engaging ends from said lugs, thereby unfastening the end attachment from the watch; and (d) means for releasably locking said levers and sliding member together when the cam surfaces and cam-engaging surfaces thereof are in the position which effects engagement of the end attachment to the watch.

10. The end attachment of claim 9 wherein the lug-engaging end of each lever includes an outwardly projecting pin to engage a corresponding hole in each watch lug.

11. The end attachment of claim 9 wherein the cam surfaces of the levers face one another in opposed relation and the cam-engaging surfaces of the sliding member are disposed on opposite sides of said member facing said cam surfaces.

12. The end attachment of claim 9 wherein the sliding member includes a projecting tab manually operable from outside the housing.

13. The end attachment of claim 12 wherein the housing includes an elongated access opening on a wall between said side apertures through which opening the tab of the sliding member projects.

14. The end attachment of claim 9 wherein the locking means comprises a spring between the sliding member and second end portion of the housing for forcing the sliding member toward the lug-engaging ends of the levers.

15. The end attachment of claim 9 wherein the locking means comprises an elongated spring extending from the pivotal end of each lever and a restraining post fastened to the housing adjacent the end of the spring against which post the spring is flexed as each lever pivots so as to exert a force against each lever in the direction opposite to the pivoting direction.

16. The end attachment of claim 9 wherein the locking means comprises a leaf spring mounted on the sliding member transverse to the sliding direction and locking cam surfaces on the shank portion of each lever, the ends of the leaf spring engaging said locking surfaces to effect locking action.

17. The end attachment of claim 9 wherein the levers and locking means comprise a one-piece component comprising opposed lever portions connected together at the pivoted ends by a spring portion bowed in the direction of the lug-engaging ends of the lever portions.

18. An end attachment for watch bands adapted to be mounted between spaced lugs of a wrist watch comprising:

(a) a housing having a first end portion adapted to fit between the spaced lugs and a second end portion adapted for connection to the watch band, said housing having opposite sidewalls defining apertures one of which faces one lug and the other of which faces the other lug and a lateral wall connecting said sidewalls together, said lateral wall defining an access aperture into the housing;

(b) a pair of levers disposed in said housing one adjacent one of said sidewalls and the other adjacent the other of said sidewalls, each lever having a lug-engaging end disposed in the first end portion of said housing and a pivotal end disposed in the second end portion of said housing with a shank portion therebetween, each of said levers including a cam surface;

(c) a sliding member disposed in said housing between the opposed levers and adapted for movement therebetween from one end of said levers to the other, the sliding member including manually operable means accessible through the access aperture of said housing for translating the sliding member along the length of said levers and also including cam-engaging surfaces on opposite sides for coacting with the cam surfaces of said levers during such sliding movement, said cam surfaces and cam engaging surfaces being configured in relation to one another such that movement of the sliding member from the pivotal end toward the lug-engaging end of said levers causes the lever to pivot toward the respective sidewalls with the lug-engaging ends extending through the sidewall apertures for engagement with the respective lugs, thereby adjusting and fastening the end attachment to the watch, and such that movement of the sliding member in the reverse direction causes disengagement of said lug-engaging ends from said lugs, thereby unfastening the end attachment from the watch; and (d) means for releasably locking said levers and sliding member together when the cam surfaces and cam-engaging surfaces thereof are in the position which effects engagement of the end attachment to the watch.

19. The end attachment of claim 18 wherein the lug-engaging end of each lever includes an outwardly projecting pin to engage a corresponding hole in each watch lug.

20. The end attachment of claim 18 wherein the cam surfaces of the levers face one another in opposed relation and the cam engaging surfaces of the sliding member are disposed on opposite sides of said member facing said cam surface.

21. The end attachment of claim 18 wherein the sliding member includes a projecting tab through the access aperture of the housing as the manually operable means.

22. The end attachment of claim 18 wherein the locking means comprises a spring between the sliding member and second end portion of the housing for forcing the sliding member toward the lug-engaging ends of the levers.

23. The end attachment of claim 18 wherein the locking means comprises an elongated spring extending from the pivotal end of each lever and restraining post fastened to the housing adjacent the end of the spring against which post the spring is flexed as each lever pivots so as to exert a force against each lever in the direction opposite to the pivoting direction.

24. The end attachment of claim 18 wherein the locking means comprises a leaf spring mounted on the sliding member transverse to the sliding direction and locking cam surfaces on the shank portion of each lever, the ends of the leaf spring engaging said locking-surfaces to effect locking action.

25. The end attachment of claim 18 wherein the levers and locking means comprise a one-piece component comprising opposed lever portions connected together at the pivotal ends by a spring portion bowed in the direction of the lug-engaging ends of the lever portions.

* * * * *